US007913327B2

(12) United States Patent
Meike et al.

(10) Patent No.: US 7,913,327 B2
(45) Date of Patent: Mar. 29, 2011

(54) AUTOMATICALLY FLUSHING TOILET

(75) Inventors: Donald Lewis Meike, Kaycee, WY (US); David Yakos, Bozeman, MT (US); Stephen Sanford, Bozeman, MT (US); Bryan Walthall, Bozeman, MT (US)

(73) Assignee: Donald Lewis Meike, Kaycee, WY (US)

( * ) Notice: Subject to any disclaimer, the term of this patent is extended or adjusted under 35 U.S.C. 154(b) by 0 days.

(21) Appl. No.: 12/842,036

(22) Filed: Jul. 23, 2010

(65) Prior Publication Data

US 2010/0325785 A1 Dec. 30, 2010

Related U.S. Application Data

(63) Continuation-in-part of application No. 12/586,684, filed on Sep. 25, 2009, now Pat. No. 7,793,363, which is a continuation-in-part of application No. 12/214,475, filed on Jun. 20, 2008, now abandoned.

(51) Int. Cl.
*E03D 5/04* (2006.01)

(52) U.S. Cl. ..... 4/250; 4/249; 4/411; 4/246.5

(58) Field of Classification Search ..... 4/249, 250, 4/411, 246, 5

See application file for complete search history.

(56) References Cited

U.S. PATENT DOCUMENTS

| | | | | |
|---|---|---|---|---|
| 385,823 | A | | 7/1888 | Paradice |
| 638,888 | A | | 12/1899 | Schlieder |
| 657,278 | A | | 9/1900 | Barton |
| 1,048,867 | A | | 12/1912 | Payne |
| 1,277,275 | A | | 8/1918 | Vogel |
| 1,446,773 | A | | 2/1923 | Sweeney |
| 1,595,741 | A | | 8/1926 | Sweeney |
| 1,605,939 | A | | 11/1926 | Hass |
| 1,720,558 | A | | 7/1929 | Lewis |
| 2,164,503 | A | | 7/1939 | Desroche |
| 2,200,687 | A | | 5/1940 | Bercot |
| 2,283,678 | A | | 5/1942 | Landis |
| 2,428,685 | A | | 10/1947 | Shepard |
| 2,628,363 | A | | 2/1953 | Stein |
| 2,679,651 | A | * | 6/1954 | Pokorny ..... 4/411 |
| 3,780,384 | A | | 12/1973 | Rivelle |
| 4,108,202 | A | * | 8/1978 | Schoepe ..... 137/436 |
| 4,329,745 | A | | 5/1982 | Aguero |
| 5,177,818 | A | | 1/1993 | Tsai |
| 5,280,653 | A | | 1/1994 | Tsai |
| 5,349,703 | A | | 9/1994 | Mocilnikar et al. |
| 5,400,446 | A | | 3/1995 | Bloemer et al. |
| 5,410,766 | A | | 5/1995 | Schumacher |
| 5,754,986 | A | * | 5/1998 | Chien ..... 4/327 |
| 2007/0044216 | A1 | | 3/2007 | Cosby |

* cited by examiner

*Primary Examiner* — Gregory L Huson
*Assistant Examiner* — Karen Younkins
(74) *Attorney, Agent, or Firm* — Antoinette M. Tease

(57) ABSTRACT

An automatically flushing toilet in which an extension arm is attached to a horizontal bar to which the toilet seat is attached. When the toilet seat is raised, one end of the extension arm moves downward, causing a rod on the end of the inner tube of a telescoping member located primarily inside the tank compartment of the toilet to move so that it is positioned atop a pivoting member located inside a cut-out on the same end of the extension arm. When the toilet seat is then closed, the one end of the extension arm moves upward, pushing the pivoting member against the rod and causing the rod to force the inner tube of the telescoping member upward. The inner tube is pivotally connected to a trip lever, which causes the toilet to flush.

6 Claims, 11 Drawing Sheets

AUTOMATICALLY FLUSHING TOILET

CROSS-REFERENCE TO RELATED APPLICATION

This application is a continuation-in-part of U.S. patent application Ser. No. 12/586,684 filed on Sep. 25, 2009, now U.S. Pat. No. 7,793,363 which in turn is a continuation-in-part of U.S. patent application Ser. No. 12/214,475 filed on Jun. 20, 2008 now abandoned. The contents of these applications are incorporated herein by reference.

BACKGROUND OF THE INVENTION

1. Field of the Invention

The present invention relates generally to the field of toilets, and more specifically, to a toilet that flushes automatically when the toilet seat cover is closed.

2. Description of the Related Art

A number of automatically flushing toilets have been patented, but none of these inventions possesses the unique structural features of the present invention, as described more fully below. For example, U.S. Pat. No. 385,823 (Paradice, 1888), U.S. Pat. No. 638,888 (Schlieder, 2899), U.S. Pat. No. 1,048,867 (Payne, 1912), U.S. Pat. No. 2,164,503 (Desroche, 1939), U.S. Pat. No. 2,628,363 (Stein, 1953) and U.S. Pat. No. 4,329,745 (Aguero, 1982) all relate to toilets that flush when weight is lifted from the toilet seat. U.S. Pat. No. 5,280,653 (Tsai, 1994) discloses a transceiver-operated toilet that flushes when the user leaves the toilet seat and stands up.

U.S. Pat. No. 657,278 (Barton, 1900), U.S. Pat. No. 1,277,275 (Vogel, 1928), U.S. Pat. No. 1,446,773 (Sweeney, 1923), U.S. Pat. No. 1,595,741 (Sweeney, 1926), U.S. Pat. No. 1,605,939 (Haas, 1926), U.S. Pat. No. 1,720,558 (Lewis, 1929), U.S. Pat. No. 2,283,678 (Landis, 1942), U.S. Pat. No. 3,780,384 (Rivelle, 1973) and U.S. Pat. No. 5,177,818 (Tsai, 1993) all involve toilets that flush when the seat is raised.

U.S. Pat. No. 2,200,687 (Bercot, 1940) discloses a motor-operated toilet that automatically flushes when the seat or seat cover is closed. U.S. Pat. No. 2,428,685 (Shepard, 1947) provides a toilet that flushes upon lowering of the toilet seat cover. In the latter invention, the cover is biased to its closed position by counterweight means and a rack and pinion interconnecting the seat and cover for moving the seat forward when the cover is raised and for holding the cover in a raised position when the seat is occupied.

U.S. Pat. No. 5,349,703 (Mocilnikar et al., 1994) also discloses a toilet that flushes automatically when the toilet lid is closed. The toilet lid comprises a toothed sprocket that engages with a first sleeve that is rotatably mounted on the hinge bar and has teeth arranged annularly at one end for engaging the toothed sprocket. Rotation of the lid causes the first sleeve to rotate about a horizontal hinge bar, thereby causing a second sleeve to slide along the hinge bar in linear motion to pull a flexible cable that actuates the flushing mechanism.

U.S. Pat. No. 5,400,446 (Bloemer et al., 1995) describes a toilet that flushes automatically when the toilet seat cover is closed. The latter invention operates by means of a magnet, sensor and batter-powered motor.

U.S. Pat. No. 5,410,766 (Schumacher, 1995) provides another toilet that flushes automatically when the toilet seat cover is closed. This invention is mechanically operated and comprises an actuating lever pivotally mounted about a first fulcrum, a tripping lever pivotally mounted about a second fulcrum, a first link connecting the actuating lever to a flapper valve, a second link connecting the actuating lever to the tripping lever, and a tripping mechanism for pivoting the tripping lever about the second fulcrum and releasing the tripping lever when the toilet seat cover is moved to a closed position.

U.S. Patent Application Pub. No. 2007/0044216 (Cosby) discloses a toilet that flushes automatically when the toilet seat is lowered. In operation, depression of a seat lifting pedal causes a lifting rod to push the seat to a vertical position from a horizontal position. When pressure is removed from the seat lifting pedal, the seat returns to a horizontal position, and a rod engages a flush arm, thereby activating the flushing mechanism.

As the above discussion makes clear, the majority of automatically flushing toilets flush either when the user leaves the toilet seat or when the toilet seat is raised. The present invention flushes automatically when the toilet seat and lid are closed. In one embodiment, there is no toilet flush handle, which means that the user must manually close the toilet seat and lid in order to flush the toilet. In an alternate embodiment, there is a toilet flush handle, and the toilet is flushed either when the user depresses the toilet flush handle or when the toilet seat and lid are closed. Unlike Bercot and Bloemer, discussed above, the present invention is mechanically operated and does not involve the use of a motor.

The mechanism by which the present invention operates is very different than the mechanisms described in Shepard, Mocilnikar et al., Schumacher and Cosby, discussed above. As described and illustrated herein, the present invention is superior to these designs by virtue of its simplicity of design and ease of manufacture.

BRIEF SUMMARY OF THE INVENTION

The present invention is an automatically flushing toilet comprising: a horizontal bar to which both a toilet seat and a toilet seat cover are attached; an extension arm having a first end and a second end, the first end being connected to the horizontal bar and the second end comprising a cut-out; a telescoping member comprising an outer tube located entirely within a tank compartment of a toilet and an inner tube that is situated inside of the outer tube and that moves vertically within the outer tube; a pivoting member that is pivotally attached to the second end of the extension arm and that has a side edge and a top edge; a spring that biases the pivoting member to move forward within the cut-out in the second end of the extension arm; and a laterally extending rod that is connected to an extension of the inner tube and that extends laterally through the cut-out in the second end of the extension arm; wherein when the toilet seat cover is lifted, the second end of the extension arm moves downward, and the rod pushes the pivoting member rearward within the cut-out in the second end of the extension arm and simultaneously travels upward along the side edge of the pivoting member until it reaches the top edge of the pivoting member, at which point the spring causes the pivoting member to move forward, resulting in the rod being positioned on top of the top edge of the pivoting member; wherein when the toilet seat cover is lowered after being raised, the second end of the extension arm moves upward, causing the rod to push the inner tube upward within the outer tube of the telescoping member; wherein the inner tube is connected to a trip lever that is connected to a chain that is connected to a toilet flapper; and wherein when the inner tube is pushed upward within the outer tube of the telescoping member, one end of the trip lever is raised, thereby causing the chain to lift the toilet flapper and causing the toilet to flush.

In a preferred embodiment, the horizontal bar comprises a first end that is inserted into a cut-out in the first end of the extension arm; the first end of the horizontal bar is circular and comprises two outwardly extending protrusions; the first end of the extension arm comprises an inner face and a circular cut-out within the inner face; the cut-out in the inner face of the first end of the extension arm comprises two inwardly extending protrusions; and the outwardly extending protrusions of the first end of the horizontal bar and the inwardly extending protrusions of the cut-out in the inner face of the first end of the extension arm are configured such that the toilet seat cover may be lifted for a certain distance before the second end of the extension arm moves downward, and the toilet seat cover may be lowered for a certain distance after being completely raised before the second end of the extension arm moves upward. In one embodiment, the toilet does not comprise a flush handle.

In a preferred embodiment, the invention further comprises a tank compartment with an inner wall; the trip lever comprises a first end and a second end; the first end of the trip lever is pivotally attached to the inner wall of the tank compartment; the second end of the trip lever is connected to the chain; the inner tube has a top end; and the top end of the inner tube is pivotally connected to the trip lever at a point between the first and second ends of the trip lever such that when the inner tube is raised, the second end of the trip lever is also raised.

In a preferred embodiment, the invention further comprises a flush handle that is connected to the trip lever. Preferably, the trip lever comprises a first end and a second end; the first end of the trip lever is connected to the flush handle; the second end of the trip lever is connected to the chain; the inner tube has a top end; and the top end of the inner tube is pivotally connected to the trip lever at a point between the first and second ends of the trip lever such that when the inner tube is raised, the second end of the trip lever is also raised.

REFERENCE NUMBERS

Figure 1:
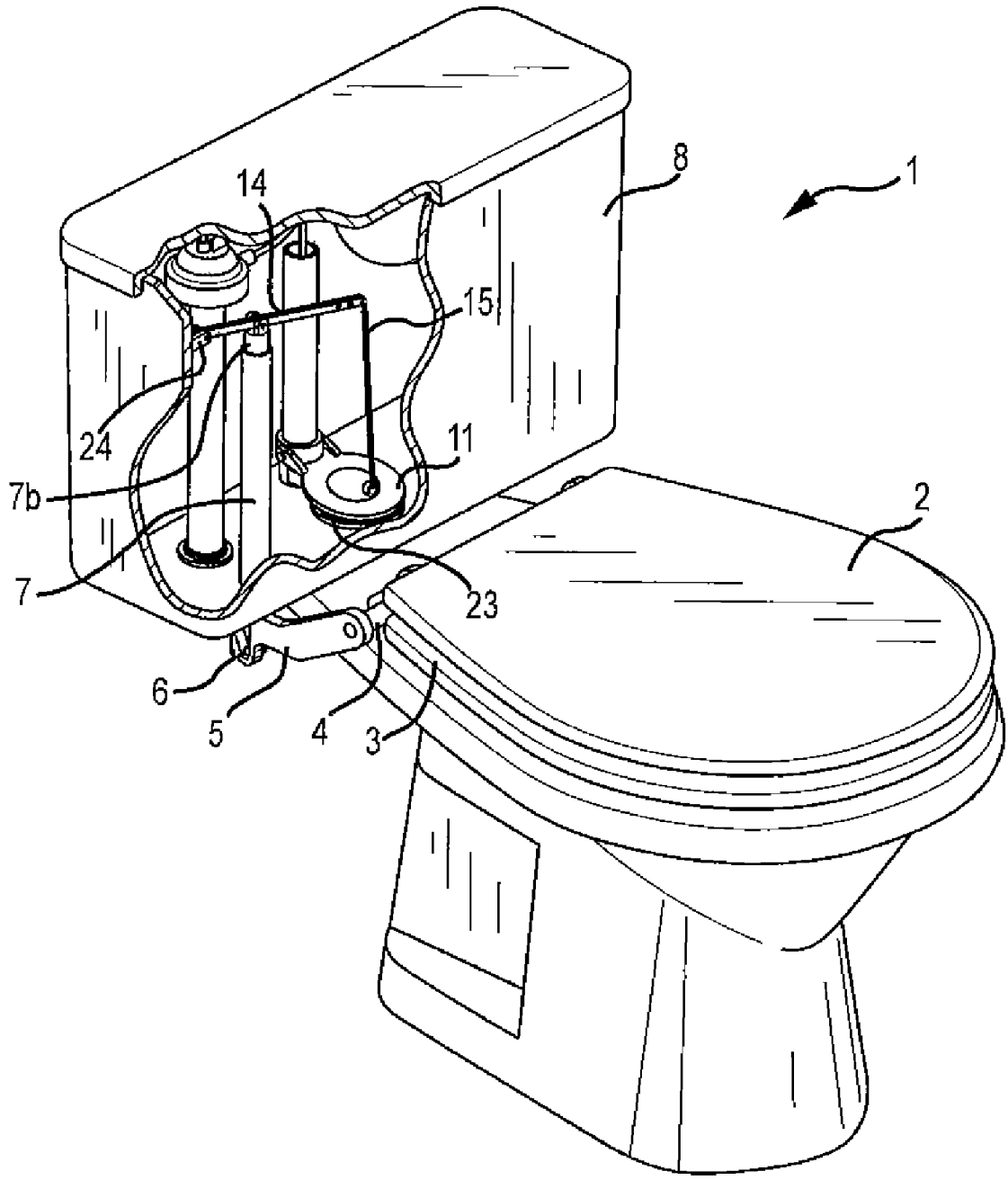
FIG. 1 is a perspective view of a first embodiment of the present invention.

1 Toilet
2 Toilet seat cover
3 Toilet seat
4 Horizontal bar
4*a* End (of horizontal bar)
5 Extension arm
5*a* Inner face (of extension arm)
6 Laterally extending rod (on telescoping member)
7 Telescoping member
7*a* Outer tube (of telescoping member)
7*b* Inner tube (of telescoping member)
8 Tank compartment
9 Cut-out (in extension arm)
10 Pivoting member
11 Toilet flapper
12 Pivot point (extension arm and pivoting member)
13 Torsion spring
14 Trip lever
15 Chain
16 Cut-out (in inner face of extension arm)
17 Bracket
18 Outwardly extending protrusions (on end of horizontal bar)
19 Inwardly extending protrusions (in cut-out on inner face of extension arm)
20 Stationary axis (point at which horizontal bar connects to extension arm)
21 Extension (of pivoting member)
22 Toilet flush handle
23 Flush valve seat
24 Pivot point (trip lever on inner wall of tank compartment)
25 Hinge

DETAILED DESCRIPTION OF INVENTION

FIG. 1 is a perspective view of a first embodiment of the present invention. In this embodiment, the toilet 1 has no flush handle; therefore, the toilet seat cover (or lid) 2 must be closed in order to flush the toilet. As shown more closely in FIG. 8, the toilet seat cover 2 is fixedly attached to a horizontal bar 4 such that when the cover 2 is raised, the horizontal bar 4 rotates, thereby causing an extension arm 5 to move vertically downward. When the extension arm 5 moves vertically downward, a laterally extending rod 6 (see FIGS. 2-7) on the end of a telescoping member 7 situated mainly (but not entirely) within the tank compartment 8 is repositioned inside of a cut-out 9 (see FIGS. 2-7) in the extension arm 5 so that it lies on top of the top edge of a pivoting member 10 (see FIGS. 2-7) that is pivotally attached to the extension arm 5. When the cover 2 is lowered, the rod 6 simultaneously pushes the telescoping member 7 upward and repositions itself so that it is adjacent to the side edge of the pivoting member 10. When the telescoping member 7 is pushed upward, it causes the toilet flapper 11 to lift, thereby flushing the toilet. The structure and operation of the present invention are discussed more fully below in connection with subsequent figures.

Figure 2:
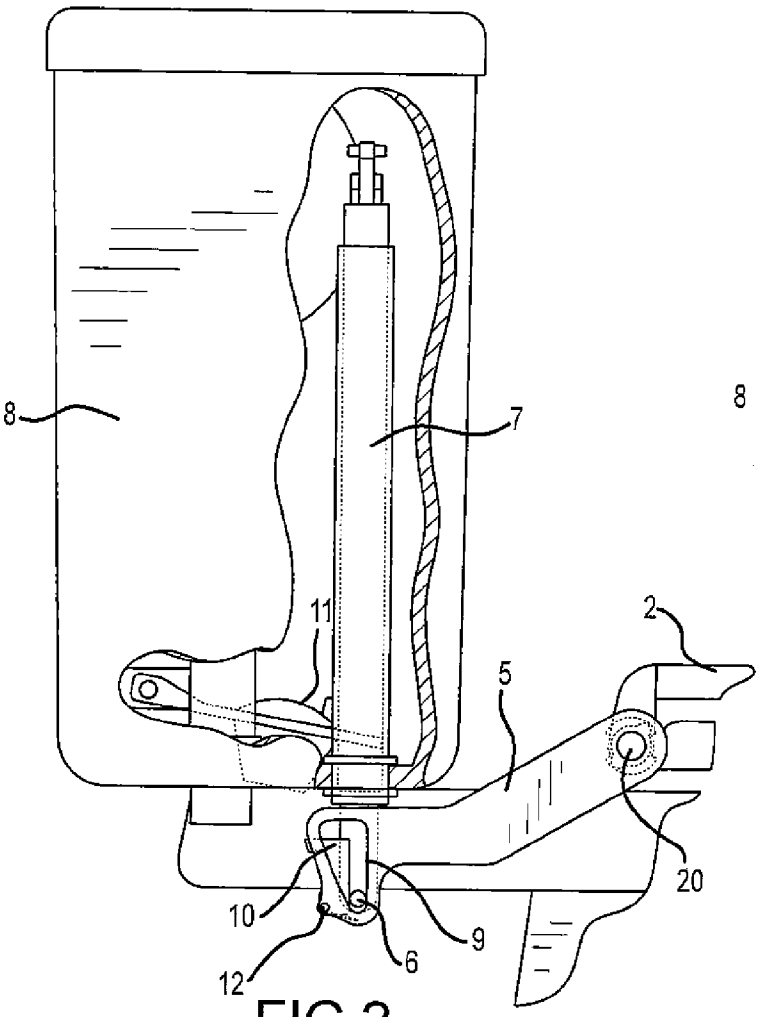
FIG. 2 is a side view of the present invention with the toilet seat cover in a closed (horizontal) position.

FIGS. 2-7 illustrate the mode of operation of the present invention. In FIG. 2, the toilet seat cover is in a closed (horizontal) position prior to use. As shown in this figure, the extension arm 5 comprises a cut-out 9 through which extends a laterally extending rod 6 on the end of a telescoping member 7. The vertical movement of the rod 7 is limited by the height of the cut-out 9. The pivoting member 10 is pivotally attached to the extension arm 5 at a pivot point 12. FIG. 2 shows the position of the extension arm 5, rod 6 and pivoting member 10 when the toilet seat cover 2 is fully closed.

Figure 3:
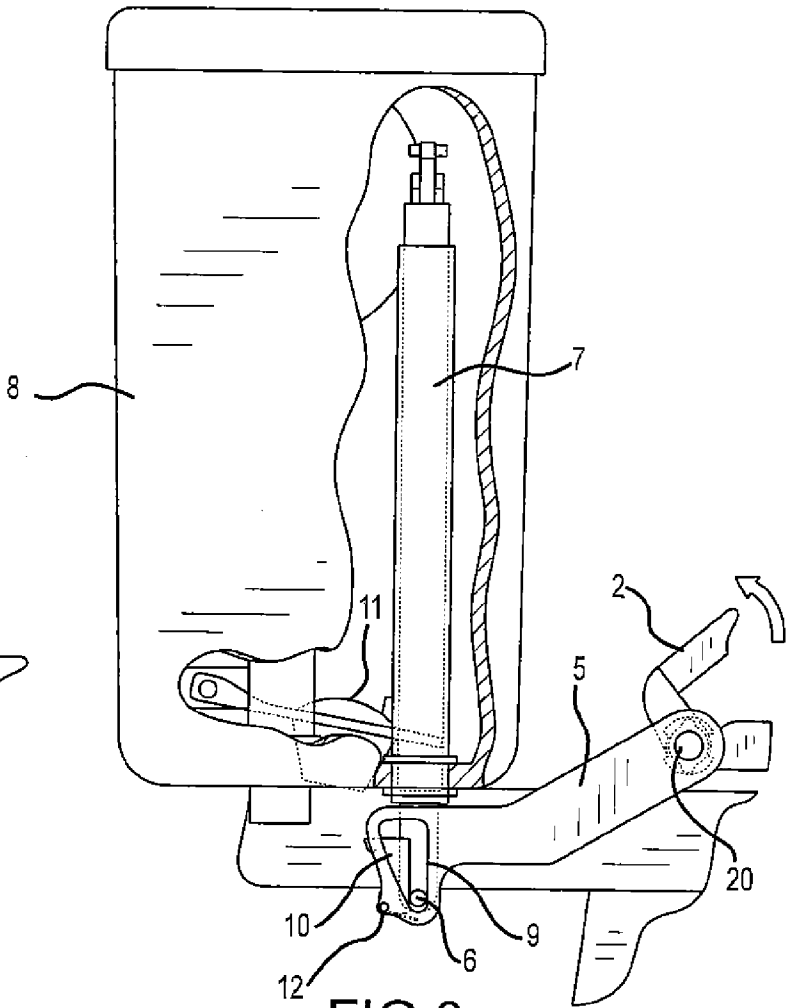
FIG. 3 is a side view of the present invention with the toilet seat cover partially raised.
Figure 5:
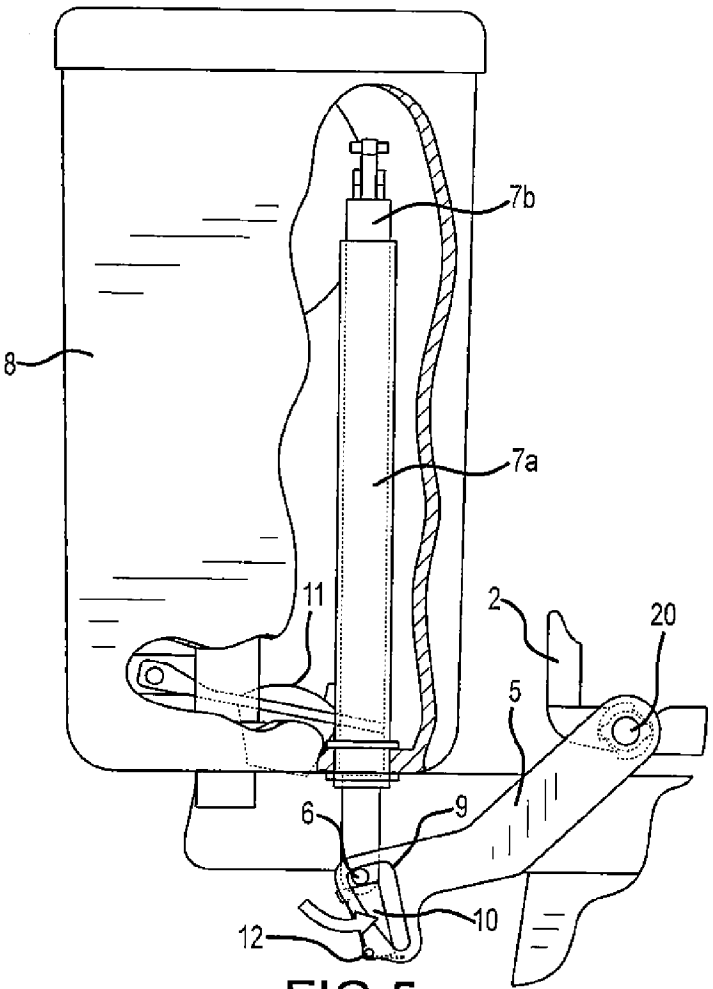
FIG. 5 is a side view of the present invention with the toilet seat cover in an open (vertical) position.
Figure 4:
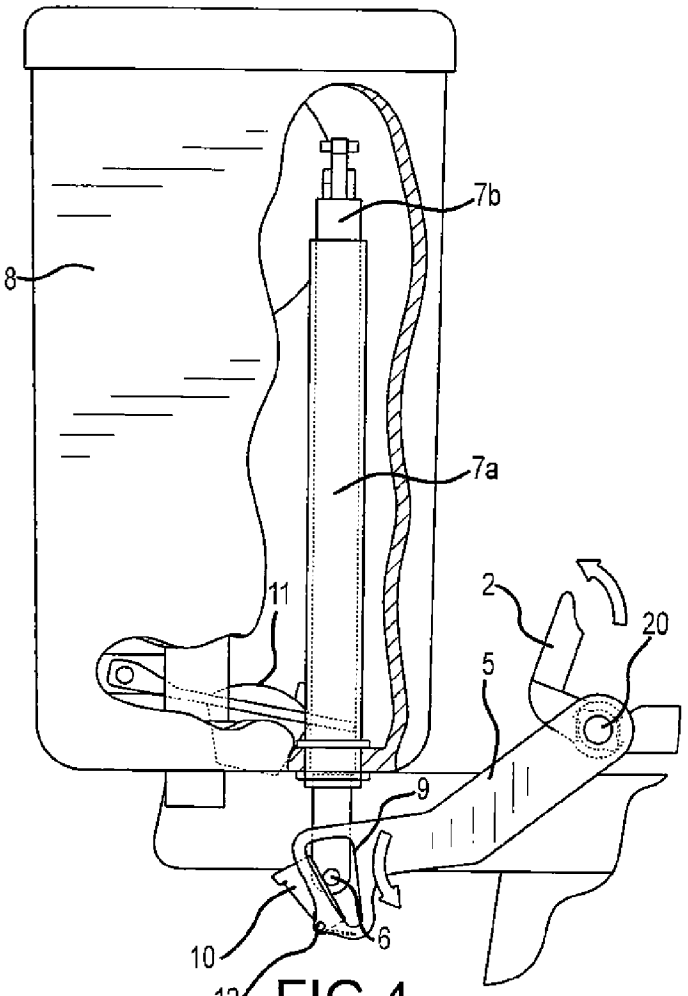
FIG. 4 is a side view of the present invention with the toilet seat cover partially raised.
Figure 7:
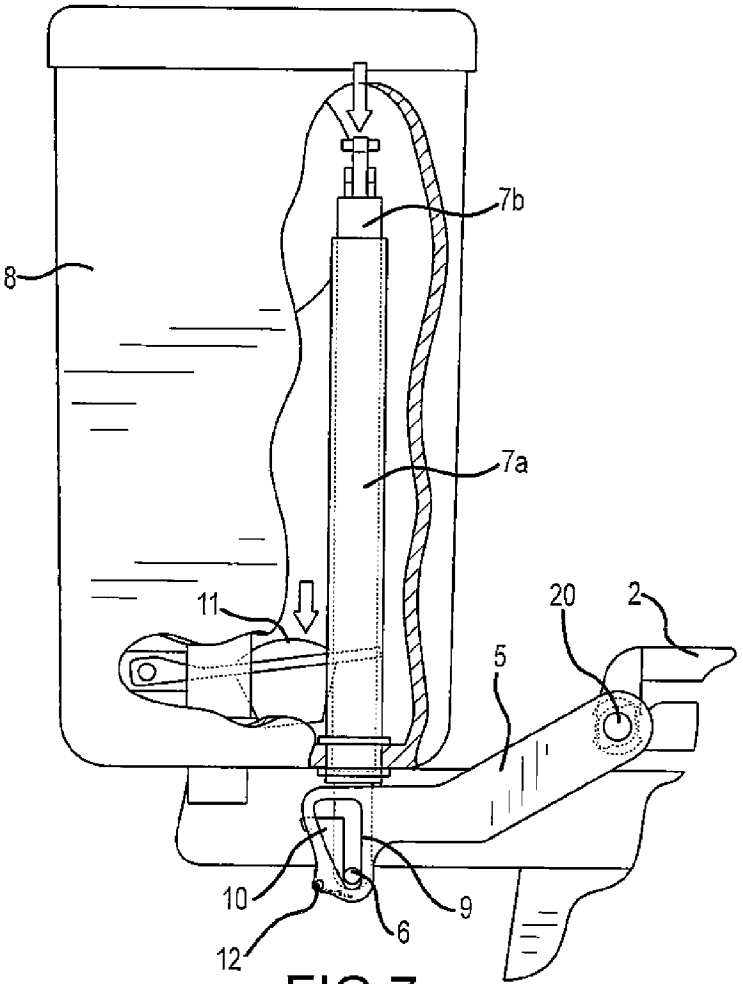
FIG. 7 is a side view of the present invention with the toilet seat cover in a closed (horizontal) position.

In FIG. 3, the toilet seat cover 2 has been partially raised. As explained more fully in connection with FIG. 8, the extension arm 5, rod 6 and pivoting member 10 do not move until the toilet seat cover 2 is raised far enough to engage the extension arm 5. At that point, as shown in FIG. 4, the extension arm 5 begins to move downward, and, by virtue of the shape of the extension arm 4 and cut-out 9, the rod 6 pushes the pivoting member 10 to the left so that the right side edge of the pivoting member 10 is nearly parallel with the left side of the cut-out 9. When the toilet seat cover 2 is raised to a fully vertical position, as shown in FIG. 5, the extension arm 5 is now low enough that the rod 6 has traveled all of the way up the right side edge of the pivoting member 10 and is positioned over the top edge of the pivoting member 10. A spring 13 (see FIG. 9) causes the pivoting member 10 to return to the position shown in FIG. 5 once the rod 6 is no longer forcing it to the left (or rearward). In the position shown in FIG. 5, the toilet is ready for use and has not yet flushed.

Figure 6:
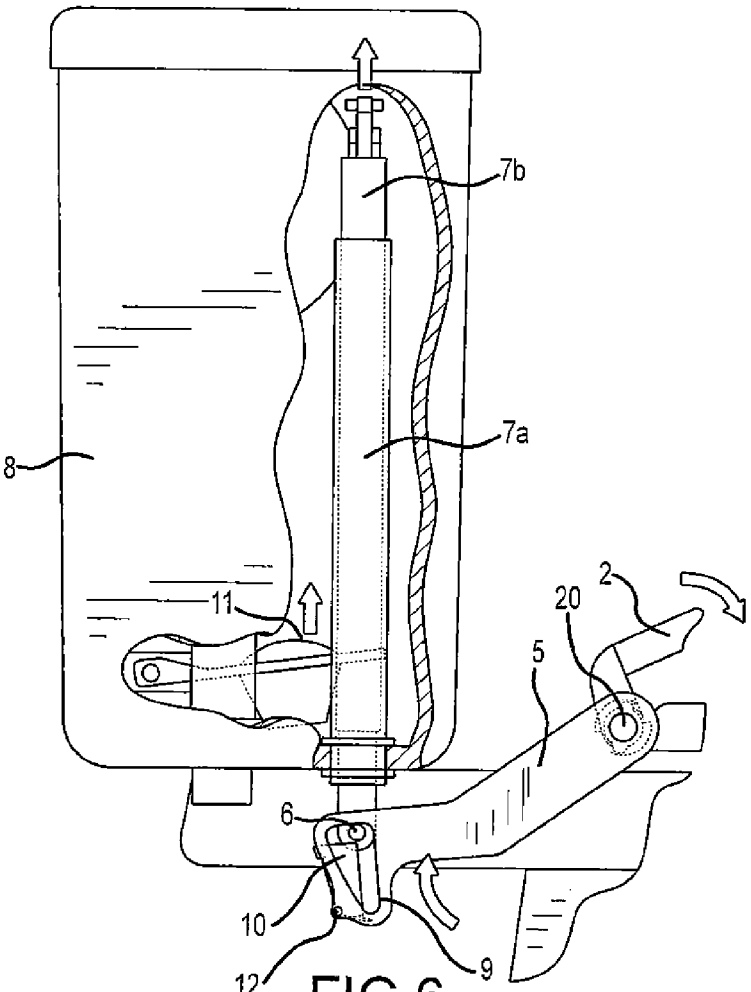
FIG. 6 is a side view of the present invention with the toilet seat cover partially closed.

In FIG. 6, the user has finished his business on the toilet and begun to lower the toilet seat cover 2. The telescoping member 7 comprises an outer tube 7*a* that is fixedly attached to the floor of the tank compartment 8 and an inner tube 7*b* that moves vertically within the outer tube 7*a*. As will become apparent by comparing FIG. 5 to FIGS. 6 and 7, as the toilet seat cover 2 is lowered after use, the extension arm 5 moves upward, thereby causing the rod 6 to move to the right (or forward) relative to the top edge of the pivoting member 10 until it reaches the northeast corner (i.e., the point at which the top edge meets the right edge) of the pivoting member 10, at which point it travels downward (north to south) along the right edge of the pivoting member until it reaches the position shown in FIG. 7. As the rod 6 is moving to the right along the top edge of the pivoting member 10 and the extension arm 5 is moving upward, the force of the top edge of the pivoting member 10 against the rod 6 causes the rod to move upward, thereby causing the inner tube 7*b* to move upward within the outer tube 7*a* of the telescoping member 7.

As shown in FIG. 1, the top of the inner tube 7*b* is attached to a trip lever 14, which in turn is attached to a chain 15 that is attached on one end to the trip lever 14 and on the other end to the toilet flapper 11. When the inner tube 7*b* is raised within the outer tube 7*b* of the telescoping member 7, the lifting of the chain 15 by the trip lever 14 causes the toilet flapper 11 to be raised, thereby activating the flush valve and effectuating the flushing of the toilet. In this embodiment, there is no toilet flush handle, which means that the toilet seat cover 2 must be closed in order to flush the toilet.

Figure 8:
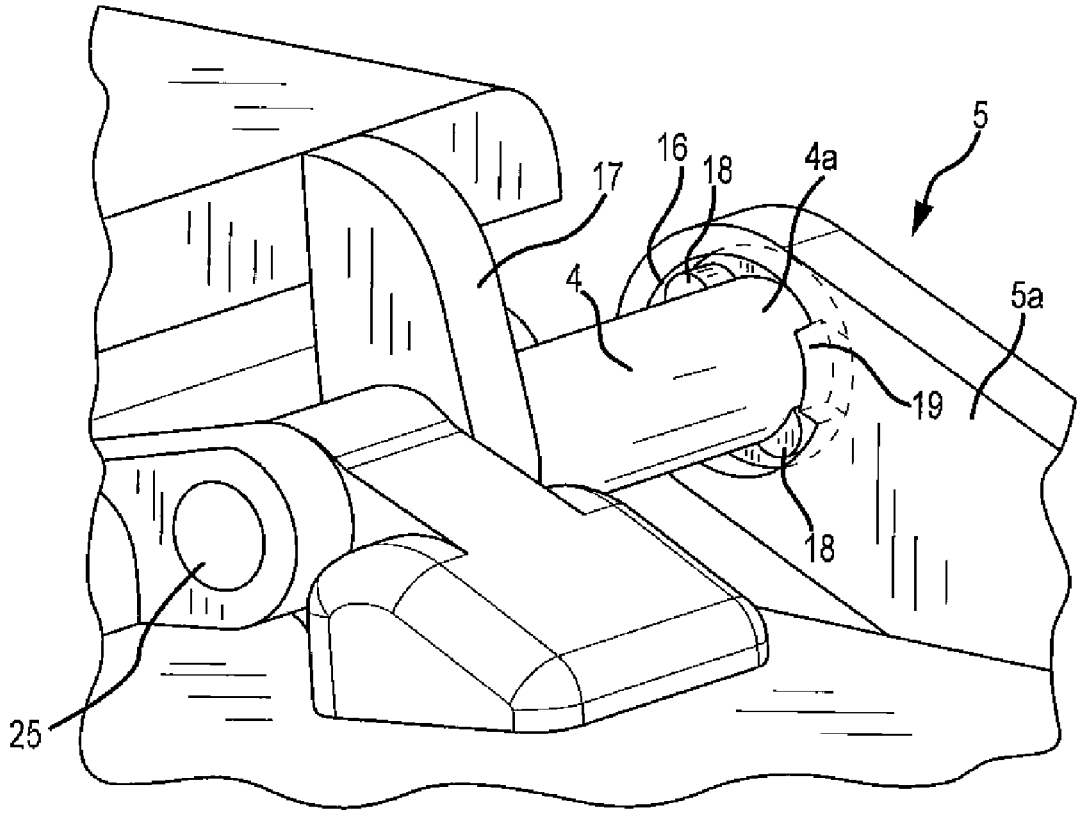
FIG. 8 is a detail perspective view of the connection between the horizontal rod and the extension arm.
Figure 8A:
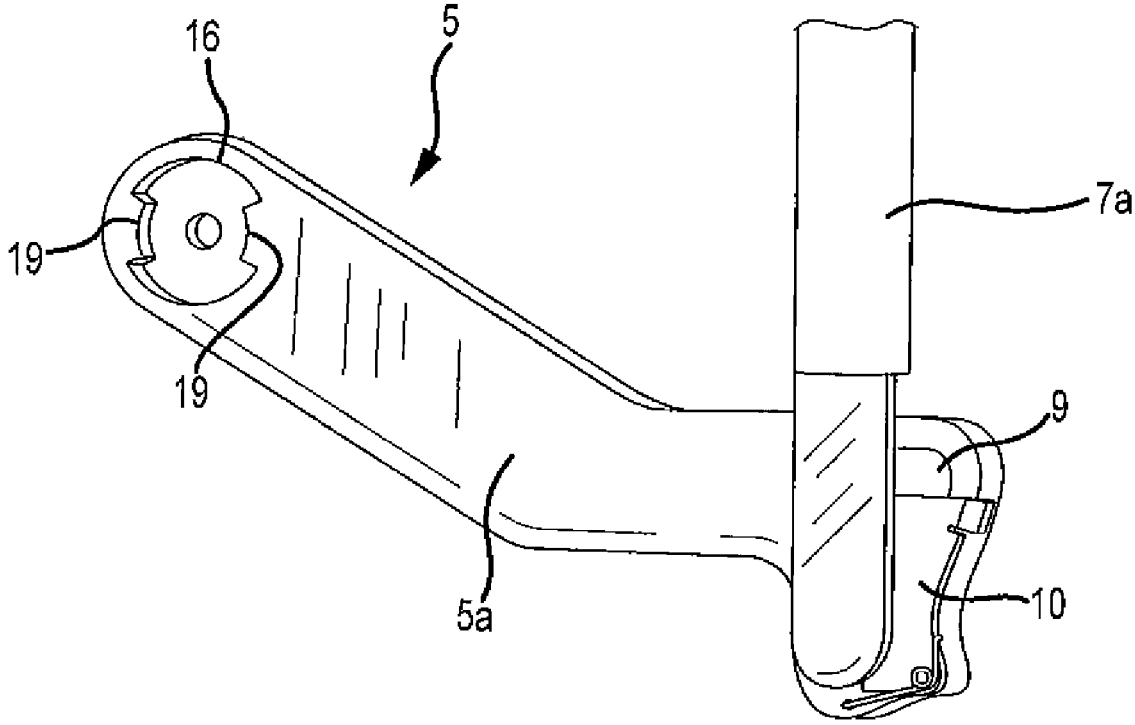
FIG. 8A is a detail perspective view of the inner face of the extension arm where it connects to the horizontal bar.
Figure 8B:
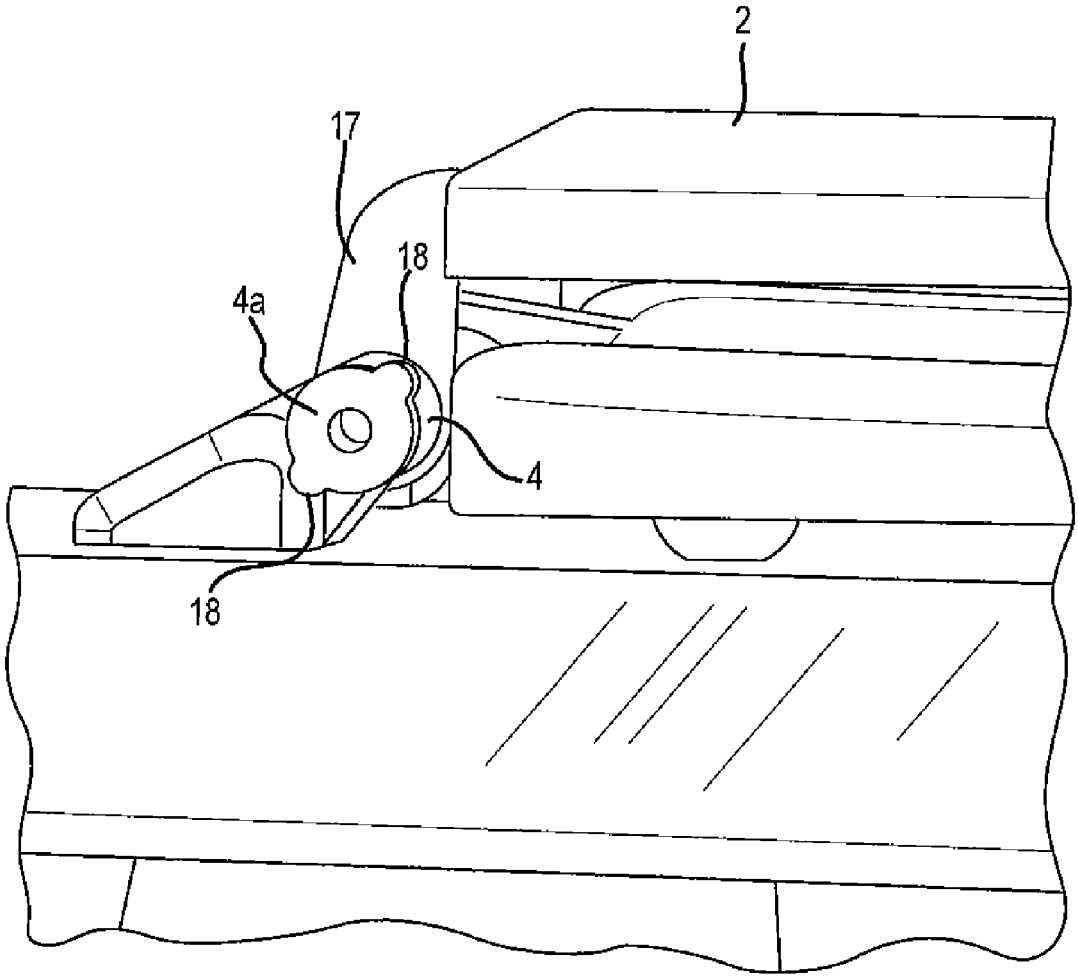
FIG. 8B is a detail perspective view of the end of the horizontal bar that is inserted into the inner face of the extension arm.

FIG. 8 is a detail perspective view of the connection between the horizontal rod and the extension arm. FIG. 8A is a detail perspective view of the inner face 5*a* of the extension arm 5 where it connects to the horizontal bar 4, and FIG. 8B is a detail perspective view of the end of the horizontal bar 4 that is inserted into the inner face 5*a* of the extension arm 5. As shown in these figures, the inner face 5*a* of the extension arm 5 comprises a cut-out 16 on one end of the extension arm 5 (the other end of the extension arm comprises cut-out 9) that extends only partially through the width of the extension arm 5. One end 4*a* of the horizontal arm 4 is inserted into the cut-out 16 and fastened in place with a screw or bolt (not shown).

The toilet seat cover 2 is connected to the horizontal bar 4 by a bracket 17. The end 4*a* of the horizontal bar 4 that is inserted into the cut-out 16 comprises two outwardly extending protrusions 18, preferably configured as shown in FIGS. 8 and 8B. The cut-out 16 is circular in shape with two inwardly extending protrusions 19. The outwardly extending protrusions 18 of the end 4*a* of the horizontal bar 4 and the inwardly extending protrusions 19 of the cut-out 16 in the inner face of the extension arm 5 are configured such that the outwardly extending protrusions 18 may travel a certain distance within the cut-out 16 before engaging with the inwardly extending protrusions 19. Upon engagement of the outwardly extending protrusions 18 and the inwardly extending protrusions 19, the extension arm 5 moves either up or down, depending on the direction of rotation of the horizontal bar 4. In this manner, and as illustrated in FIGS. 2-7, the toilet seat cover 2 may be raised a certain distance (FIG. 2 to FIG. 3) before the extension arm 5 begins moving downward, and once fully raised, the toilet seat cover 2 may be lowered a certain distance (after FIG. 5 but before FIG. 6—the extension arm has actually moved upward slightly in FIG. 6 as compared to FIG. 5) before the extension arm 5 begins to move upward.

Note that when the extension arm 5 is referred to herein as moving up or down, the first end of the extension arm 5 (i.e., the end of the extension arm 5 that is attached to the horizontal arm 4) is fixed in position, and the second end of the extension arm 5 (i.e., the end with the cut-out 9) rotates upward or downward about a stationary axis 20. The stationary axis 20 is the point at which the extension arm 5 is attached to the horizontal arm 4. The outwardly extending protrusions 18 and the inwardly extending protrusions 19 are shown with dotted lines in FIGS. 2-7.

Figure 9:
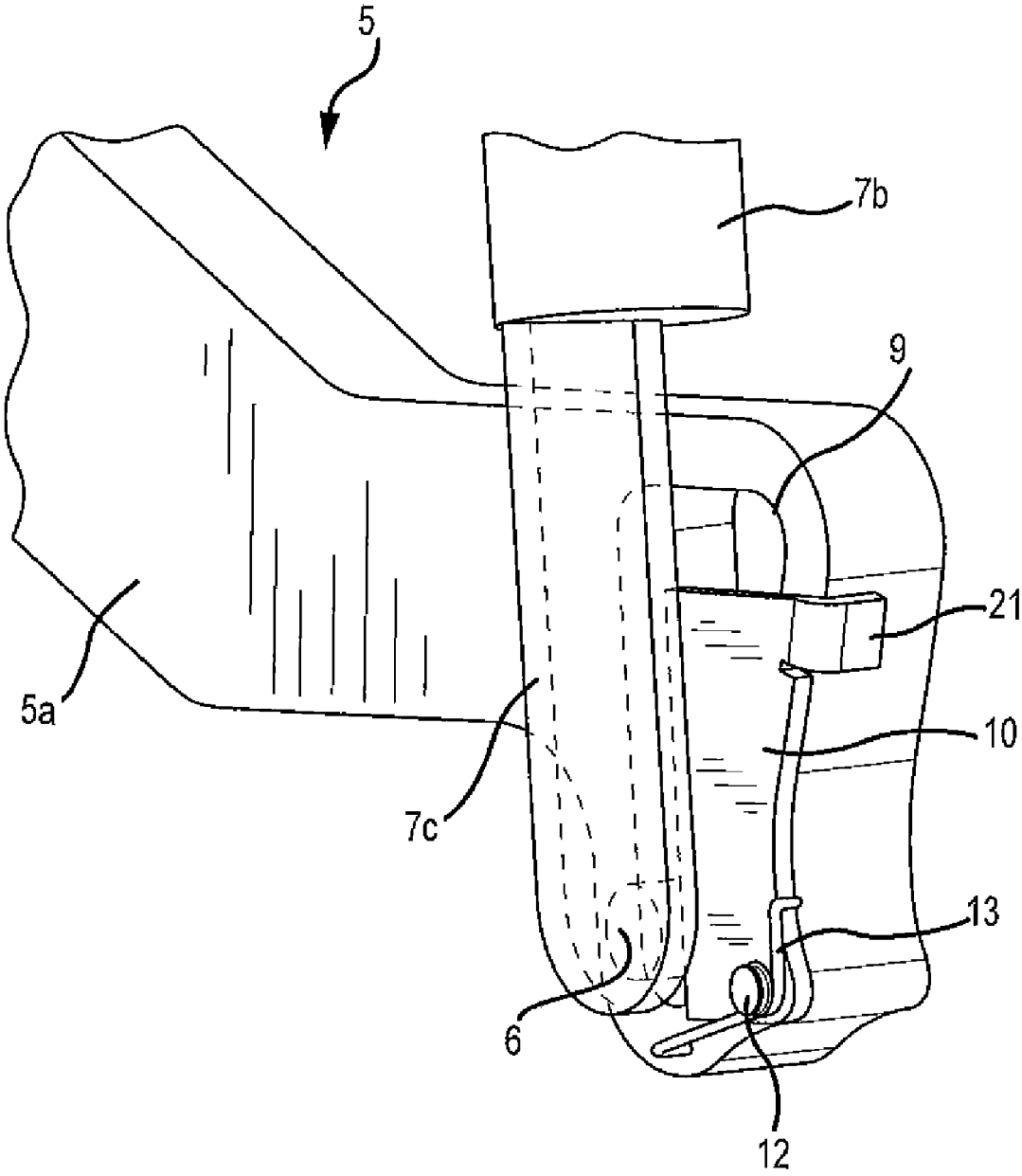
FIG. 9 is a detail perspective view of the pivoting member and extension arm.

FIG. 9 is a detail perspective view of the pivoting member 10 and extension arm 5. As shown in this figure, the inner tube 7*b* of the telescoping member 7 comprises an extension 7*c* that extends downward from the bottom of the inner tube 7*b* and from which the rod 6 extends laterally through the cut-out 9 in the extension arm 5. A torsion spring 16 is fixedly attached on one end to the extension arm 5; on its other end, the torsion spring is in contact with but not fixedly attached to the rear wall of the pivoting member 10, as shown in this figure. At its center, the torsion spring wraps around the pivot point 12 between the extension arm 5 and the pivoting member 10. In this manner, the spring 13 allows the pivoting member 10 to be pushed rearward (i.e., away from the other end of the extension arm) by the rod 6 (as shown in FIG. 4), thereby creating tension in the spring, and causes the pivoting member 10 to return to the position shown in FIG. 9 as soon as the pressure of the rod on the right side edge of the pivoting member 10 is released (see FIG. 5). The pivoting member 10 preferably comprises an extension 21 that wraps around the back of the extension arm 5 to prevent the pivoting member 10 from moving farther forward (i.e., toward the other end of the extension arm) than the position shown in FIGS. 2-3, 5-7 and 9.

In a preferred embodiment, the raising and lowering of the toilet seat 3 does not effectuate the flushing of the toilet. As shown in FIG. 8, the toilet seat 3 may rotate about the same hinge 25 as the toilet seat cover 2, but it is not fixedly attached to the horizontal bar 4 and, therefore, does not cause the extension arm 5 to move up or down. If the toilet seat cover 2 and toilet seat 3 are both raised, and then only the toilet seat 3 is lowered, the toilet would not flush. If both the toilet seat cover 2 and toilet seat 3 are raised, and then both are lowered, the toilet would flush, as described above. Thus, the user is forced (in this embodiment) to close the toilet seat cover 2—and not just lower the toilet seat 3—in order to flush the toilet.

Figure 10:
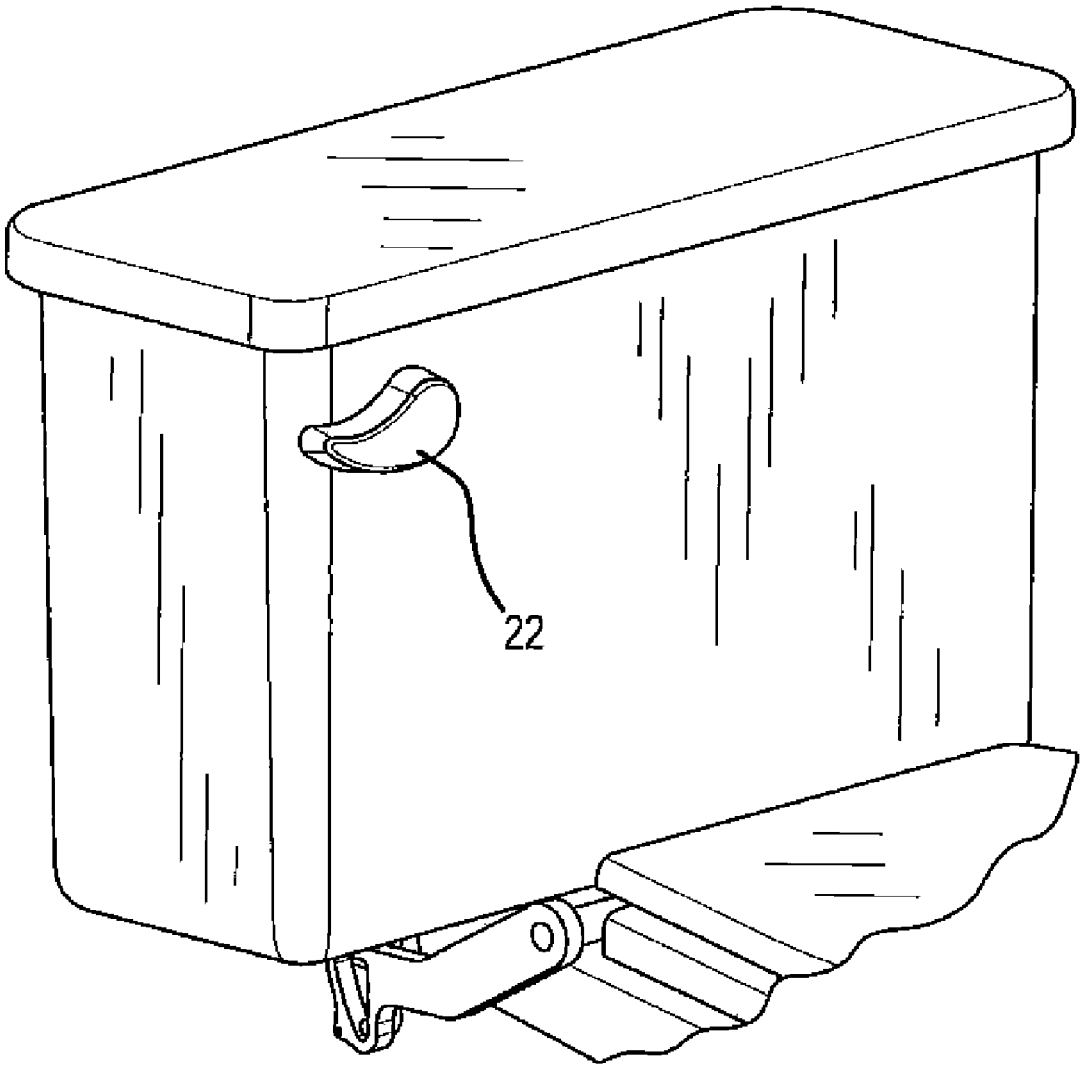
FIG. 10 is a partial perspective view of a second embodiment of the present invention.
Figure 11:
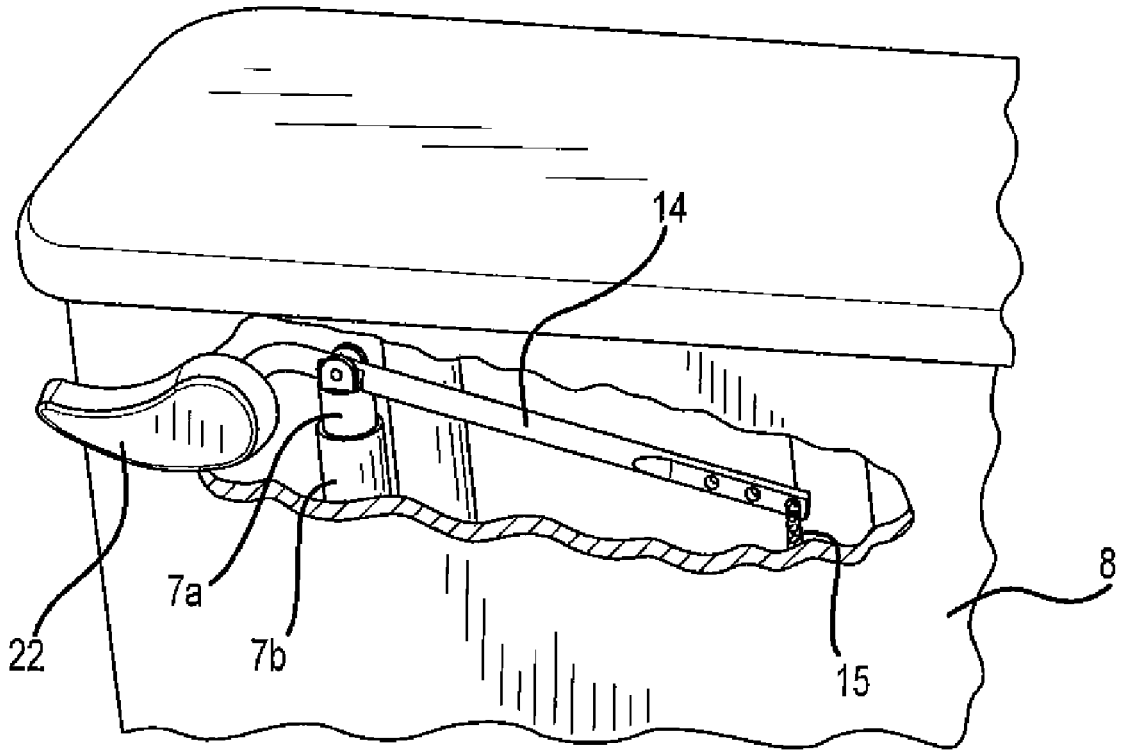
FIG. 11 is a detail perspective view of the second embodiment of the present invention.

FIGS. 10 and 11 show an alternate embodiment of the present invention that includes a toilet flush handle. This embodiment operates the same as the first embodiment described above, except that the user may flush the toilet not only by closing the toilet seat cover 2 but also by depressing the toilet flush handle 22. The toilet flush handle 22 is connected to the trip lever 14, which effectuates the flushing of the toilet when the end of the trip lever 14 that is attached to the chain 15 is raised, thereby causing the flapper 11 to lift off of the flush valve seat 23.

Figure 11A:
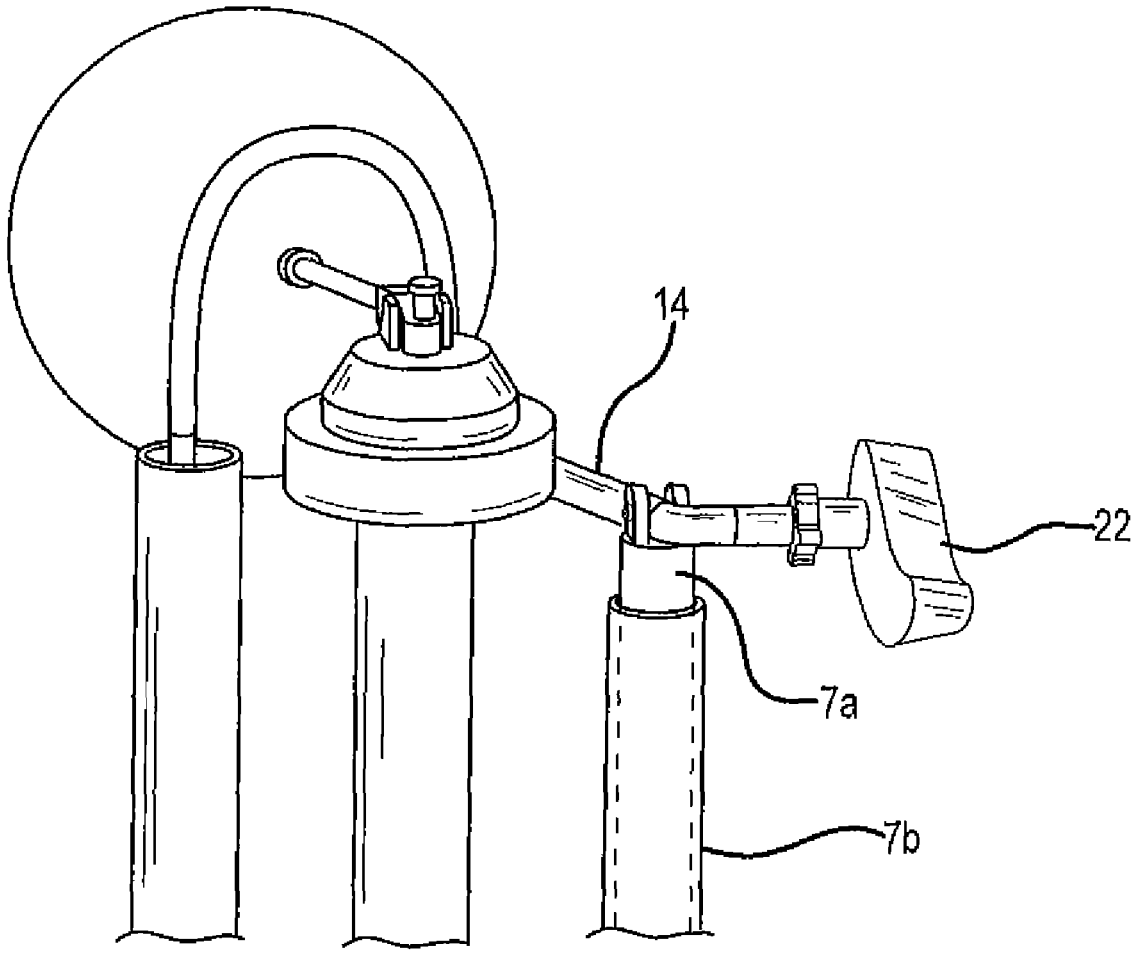
FIG. 11A is a detail perspective view of the connection between the toilet flush handle and the trip lever.

Note that in both the first and second embodiments, the top end of the inner tube 7*a* is pivotally attached to the trip lever 14 at a point between both ends of the trip lever so that the trip lever pivots (like a see-saw) on the top of the inner tube. In the first embodiment, a first end of the trip lever 14 is pivotally attached to the inner wall of the tank compartment 8 (see FIG. 1) so that when the inner tube 7*a* moves upward within the outer tuber 7*b*, the first end of the trip lever 14 pivots at the pivot point 24, and the second end of the trip lever (attached to the chain) is raised. In the second embodiment, the first end of the trip lever is connected to the toilet flush handle 22 (see FIG. 11A) such that when the toilet flush handle 22 is depressed, the opposite end of the trip lever 14 (i.e., the second end) is raised.

The present invention may be sold as a unit or as a retrofit to existing toilets. Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An automatically flushing toilet comprising:

(a) a horizontal bar to which both a toilet seat and a toilet seat cover are attached;

(b) an extension arm having a first end and a second end, the first end being connected to the horizontal bar and the second end comprising a cut-out;

(c) a telescoping member comprising an outer tube located entirely within a tank compartment of a toilet and an inner tube that is situated inside of the outer tube and that moves vertically within the outer tube;

(d) a pivoting member that is pivotally attached to the second end of the extension arm and that has a side edge and a top edge;

(e) a spring that biases the pivoting member to move forward within the cut-out in the second end of the extension arm; and (f) a laterally extending rod that is connected to an extension of the inner tube and that extends laterally through the cut-out in the second end of the extension arm;

wherein when the toilet seat cover is lifted, the second end of the extension arm moves downward, and the rod pushes the pivoting member rearward within the cut-out in the second end of the extension arm and simultaneously travels upward along the side edge of the pivoting member until it reaches the top edge of the pivoting member, at which point the spring causes the pivoting member to move forward, resulting in the rod being positioned on top of the top edge of the pivoting member;

wherein when the toilet seat cover is lowered after being raised, the second end of the extension arm moves upward, causing the rod to push the inner tube upward within the outer tube of the telescoping member;

wherein the inner tube is connected to a trip lever that is connected to a chain that is connected to a toilet flapper; and wherein when the inner tube is pushed upward within the outer tube of the telescoping member, one end of the trip lever is raised, thereby causing the chain to lift the toilet flapper and causing the toilet to flush.

2. The automatically flushing toilet of claim 1, wherein the horizontal bar comprises a first end that is inserted into a cut-out in the first end of the extension arm;

wherein the first end of the horizontal bar is circular and comprises two outwardly extending protrusions;

wherein the first end of the extension arm comprises an inner face and a circular cut-out within the inner face;

wherein the cut-out in the inner face of the first end of the extension arm comprises two inwardly extending protrusions; and wherein the outwardly extending protrusions of the first end of the horizontal bar and the inwardly extending protrusions of the cut-out in the inner face of the first end of the extension arm are configured such that the toilet seat cover may be lifted for a certain distance before the second end of the extension arm moves downward, and the toilet seat cover may be lowered for a certain distance after being completely raised before the second end of the extension arm moves upward.

3. The automatically flushing toilet of claim 1, wherein the toilet does not comprise a flush handle.

4. The automatically flushing toilet of claim 3, further comprising a tank compartment with an inner wall;

wherein the trip lever comprises a first end and a second end;

wherein the first end of the trip lever is pivotally attached to the inner wall of the tank compartment;

wherein the second end of the trip lever is connected to the chain;

wherein the inner tube has a top end; and wherein the top end of the inner tube is pivotally connected to the trip lever at a point between the first and second ends of the trip lever such that when the inner tube is raised, the second end of the trip lever is also raised.

5. The automatically flushing toilet of claim 1, further comprising a flush handle that is connected to the trip lever.

6. The automatically flushing toilet of claim 5, wherein the trip lever comprises a first end and a second end;

wherein the first end of the trip lever is connected to the flush handle;

wherein the second end of the trip lever is connected to the chain;

wherein the inner tube has a top end; and wherein the top end of the inner tube is pivotally connected to the trip lever at a point between the first and second ends of the trip lever such that when the inner tube is raised, the second end of the trip lever is also raised.

* * * * *